United States Patent [19]

Baader

[11] 4,254,313

[45] Mar. 3, 1981

[54] SNAP SWITCH

[75] Inventor: Helmut Baader, Nabburg, Fed. Rep. of Germany

[73] Assignee: Elektromanufaktur Zangenstein Hanauer GmbH & Co., Fed. Rep. of Germany

[21] Appl. No.: 36,104

[22] Filed: May 4, 1979

[30] Foreign Application Priority Data

May 5, 1978 [DE] Fed. Rep. of Germany ..... 2819795

[51] Int. Cl.[3] ..... H01H 5/20

[52] U.S. Cl. ..... 200/67 D

[58] Field of Search ..... 200/67 D, 67 DA

[56] References Cited

U.S. PATENT DOCUMENTS

| | | | |
|---|---|---|---|
| 2,980,774 | 4/1961 | Millerwise | 200/67 D |
| 3,153,125 | 10/1964 | Strauss et al. | 200/67 D X |
| 3,213,244 | 10/1965 | McCarrick | 200/67 DA X |

*Primary Examiner*—Stephen Marcus

*Attorney, Agent, or Firm*—Karl W. Flocks

[57] ABSTRACT

A snap switch is disclosed with a snap spring which is fastened on a carrier, carries at least one switch contact which connects it electrically to the carrier and has at least two arms which are reciprocally biased to form a closed system of forces in which at least one arm under compressive stress can be switched by the effect of an external driving force onto the snap spring between two switch positions in which it has different curvatures.

1 Claim, 7 Drawing Figures

SNAP SWITCH

BACKGROUND OF THE INVENTION

The present invention relates to snap switches which within the terms of the present invention are mechanically operated switches which are switched abruptly by an external driving force from one switch position to a second position when the driving force reaches a defined critical value. The speed of switching between the switch positions is largely independent of the speed with which the driving force changes.

A snap switch of the type described above is known in which the snap switch is a leaf spring in which two parallel longitudinal slots separate a pair of outer arms from a central portion which extends longitudinally parallel to the outer arms. The central portion has an indentation across its entire breadth which reduces its thickness and thus increases its length. The increase in length of the central portion, when the length of the outer arms which form a frame around the central portion remains unchanged, results in biasing of the central portion which causes the central portion to curve to one or other side of the plane of the two outer arms, while the two outer arms are under tensile stress and remain flat. This known snap switch, of which the present invention is an improvement, has significant advantages over other known snap switches in which a snap spring and/or components thereof biased thereby are mounted on knife edges. The advantages of the snap switch described reside above all in the fact that when the switch is switched over it is only necessary to overcome internal frictional resistance which is minimal and above all constant, while the frictional resistance occurring on knife edges is greater from the start and can increase considerably and unpredictably as a result of wear. Moreover, the snap spring of the known snap switch of the type described is adapted to provide a conductive connection between the carrier and the switch contact mounted on the snap spring, because a good transfer of current between the carrier and the snap spring can be ensured by no more than a clamp connection. The contact resistance on knife edge bearings, on the other hand, is considerable from the start and can increase considerably as a result of dirt or wear. A disadvantage of the known snap switch of the type described is that the biasing of the snap spring resulting from the indentation and the associated increase in length of the central portion cannot easily be held sufficiently constant in mass production so that in the known snap switches when constructional details are the same considerable variations in the switching characteristics must be expected. Thus, as a result, predetermined conditions for the change of switch positions cannot be adhered to any more accurately with known snap switches of the type described than with the other known snap switches with knife edge bearings.

SUMMARY OF THE INVENTION

The object of the present invention, therefore, is to provide a snap switch which can be mass produced so that it can be more accurately set to a predetermined switching action which does not alter significantly in the course of a long operational life with numerous switching cycles.

According to the invention this object is achieved, on the basis of a snap switch of the type described in the introduction, by providing the snap spring with a space between the adjacent ends of two arms and a welded connection of each of these arms to the carrier to determine the extent of the biasing and bridge the space in the snap spring.

Even under mass production conditions, two arms which are separated from each other by a space can be easily brought into a position in which the snap spring is subject to accurately defined biasing. It is also simple to weld the said arms in this position to the carrier and also, optionally, indirectly to each other in such a way that the present biasing is maintained. This possibility exists independently of whether the two arms which are welded to the carrier were originally formed in one piece or were originally separate components. However, for production reasons it is preferable for the arms to be produced in one piece so that they form an integral unit before being welded to the carrier.

BRIEF DESCRIPTION OF THE DRAWINGS

Advantageous embodiments of the invention are described in combination with the following description of examples which are shown diagrammatically in the drawings, in which.

DESCRIPTION OF THE PREFERRED EMBODIMENTS

Figure 1A:
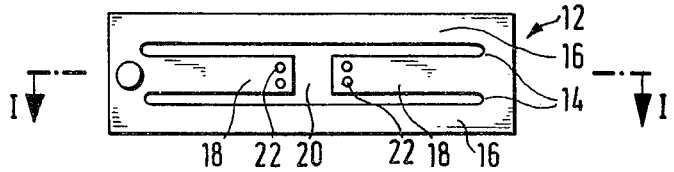
FIG. 1*a* is a partial plan view of a first snap switch.
Figure 1B:
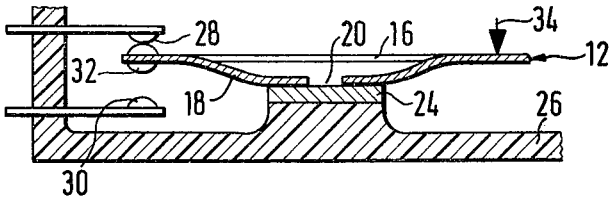
FIG. 1*b* is a section along the line I—I in FIG. 1*a;*

The snap switch shown in FIGS. 1*a* and 1*b* has a snap spring 12 in the shape of a rectangular leaf spring with two longitudinal slots 14 which separate a pair of outer arms 16 in such a way that they are connected only at their two ends to each other and to a central portion of the snap spring 12. The central portion consists of two central arms 18 which are separated by a space 20. The two longitudinal slots 14 are connected to each other approximately at the center by the space 20 so that an opening in the shape of an H is formed. The two central arms 18 which are separated from each other by the space 20 are each fastened to a rigid carrier 24 by means of two welding spots 22 close to the space 20 in such a way that the total length of the two central arms 18 and the part of the carrier 24 bridging the space 20 is greater than the length of each of the two outer arms 16. The two central arms 18 cannot therefore lie in the common plane of the outer arms 16, but form a curve to one side or the other of the common plane of the outer arms 16. Thus the two outer arms 16 are under tensile stress and the two central arms 18 under compressive stress; all of the arms 16 and 18 form together with the carrier 24 a bistable system, i.e. a system which veers from one end position to another end position and vice versa only under the effect of an external force.

The carrier 24 is mounted on a housing 26 which is made from insulating material and is shown only in FIG. 1*b* and there only in outline. Two contacts 28 and 30 are arranged opposite one another on the housing 26 at a distance from the carrier 24 and from each other. One end of the snap spring 12 projects into the space between the two contacts 28 and 30 and carries a switch contact 32 which according to FIG. 1*b* touches the upper contact 28 which is mounted on the housing. The dimensions of the snap spring 12 are such that in its switch position shown in FIG. 1*b* it attempts to push the switch contacts 32 which are mounted on it further upwards than the upper contact 28 mounted on the housing will permit, and under the effect of a force indicated by the arrow 34 in FIG. 1*b*, it springs into a switch position in which it attempts to push the switch contact 32 further downwards than the lower contact 30 mounted on the housing will permit. In this way it is ensured that the switch contact 32 rests with sufficient contact pressure on one of the two contacts 28 and 30 which are mounted on the housing. The level of the contact pressure with a given distance between the contacts 28 and 30 mounted on the housing is determined by the degree of biasing resulting from the production of the welded joint between the central arms 18 and the carrier 24.

Figure 2A:
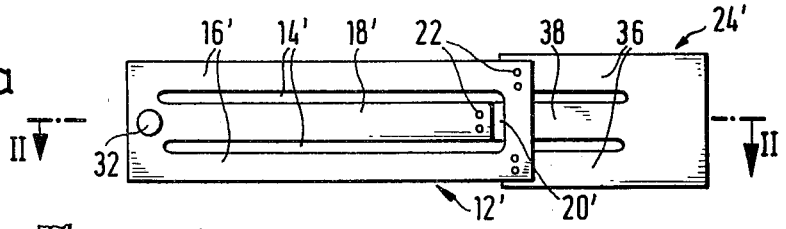
FIG. 2*a* is a partial plan view of a second snap switch.
Figure 2B:
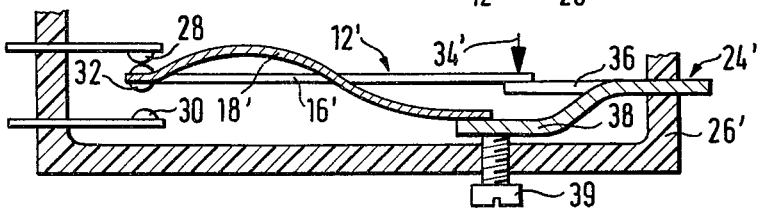
FIG. 2*b* is a section along the line II—II in FIG. 2*a;*

The individual parts of the snap switch shown in FIGS. 2*a* and 2*b* are, wherever the parts are comparable, identified by the same reference numerals as the parts shown in FIGS. 1*a* and 1*b*, the different constructions being indicated by superscripts. The snap spring 12' corresponds in its outline to the snap spring 12 but differs therefrom in that its two longitudinal slots 14' are connected to each other by a space 20' not at the center but at one end, so that the snap spring has a generally U-shaped opening defining a single central arm 18'. Instead of the carrier 24 which is relatively simple in shape in FIGS. 1*a* and 1*b*, according to FIGS. 2*a* and 2*b* a fork-shaped carrier 24' is provided which has two dovetail-like outer portions 36 lying in a common plane and a downwardly-curved dovetail-like central portion 38.

The carrier 24' is elastic to a certain degree and its central portion 38 can be supported at the housing 26', for example via a set screw 39 screwed into the bottom of the housing 26 and having an upwardly directed end exerting a pressure on said central portion 38 from below and subjecting the latter to a bending stress.

The two outer arms 16' of the snap spring 12' are welded to the outer portions 36 of the carrier 24', while the central arm 18' of the snap spring 12' is welded to the central portion 38 of the carrier 24'. When the welded joints are produced the snap spring 12' is biased so that its central arm 18' is bent in a S shape in its switch position according to FIG. 2*b*. From this switch position the snap spring 12' can switch, in a similar manner to the snap spring 12, into a position in which the switch contact 32 touches the lower contact 30 mounted on the housing. This switching is achieved by the action of a force indicated by the arrow 34' in FIG. 2*b* upon the two outer portions 36 of the carrier 24', resiliently deforming the carrier.

The adjustment of the set screw 39 determines the position of the central portion 38 of the carrier 24', and thus also the behavior of the snap spring 12'. According to FIG. 2*b*, the set screw 39 is so adjusted that the turning point of the S-shaped curve formed by the central arm 18' of the snap spring 12' is only slightly below the common plane of the outer arms 16' of the snap spring 12'. With such an adjustment of the set screw 39 the snap spring 12' is bistable. This means that the switch contact 32 is pressed against the upper contact 28 fixed to the housing, as long as the force 34' does not exceed a predetermined value. If however this value is exceeded, even if only momentarily, the snap spring 12' snaps into a lower position in which its switch contact 32 is pressed against the lower contact 30 being fixed to the housing.

The snap spring 12' returns from this lower position into its upper position according to FIG. 2*b*, only when an external force acting in opposite direction to the direction marked by arrow 34' and having a specific magnitude acts on the outer arms 16' of the snap spring 12'. Thus, the snap spring 12' according to FIGS. 2*a* and 2*b* behaves in a similar manner when the set screw 39 has the position as illustrated, as the likewise bistable snap spring 12 shown in FIGS. 1 and 2.

However, if the set screw 39 is turned in such a manner that it holds the portion 38 of the carrier 24' in a considerably higher position, then the snap spring 12' will automatically snap into its lower switch position in which the contacts 30 and 32 engage each other. In this case, the snap spring 12' can be held in its upper switch position only by the action of an external force; the snap spring is therefore mono-stable.

On the other hand, if the set screw 39 is turned such that it causes portion 38 to occupy a considerably lower position than that illustrated in FIG. 2*b*, the snap spring 12' always returns to its upper switch position automatically, as illustrated in FIG. 2*b*; here again the snap spring is monostable, for it can be held in its lower switch position only by the action of an external force.

The resilient return force occurring in the carrier 24' itself can be sufficient or insufficient, according to the dimensions of the snap spring 12' and the carrier 24', to force the snap spring 12' to spring back into the switch position shown in FIG. 2*b* when the external force indicated by the arrow 34' is absent.

Figure 3A:
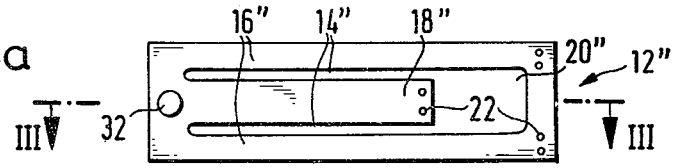
FIG. 3*a* is a partial plan view of a third snap switch.
Figure 3B:
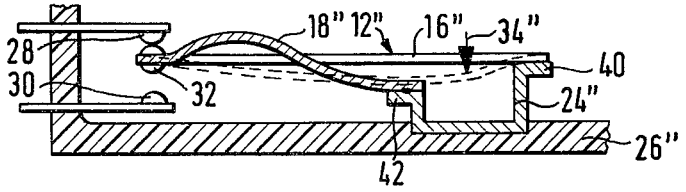
FIG. 3*b* is a section along the line III—III in FIG. 3*a;*.

The snap switch shown in FIGS. 3*a* and 3*b* differs from that shown in FIGS. 2*a* and 2*b* above all in that instead of the narrow space 20' a much wider space 20'' in the longitudinal direction of the snap spring 12' separates the pair of outer arms 16'' from the central arm 18''. A further difference resides in the provision of a generally rigid carrier 24'' with two flanges 40 and 42 offset against each other in the longitudinal direction of the snap spring 12''. The flange 40 extends over the entire width of the snap spring 12'' and is welded to the two outer arms 16'', while the flange 42 is only as wide as the central arms 18'' to which it is welded. This construction makes it possible for a force indicated by the arrow 34'' in FIG. 3*b* to deform the two outer arms 16'' as shown by dotted lines; as a result of this deformation the snap spring 12'' springs into the switch position in which its switch contact 32 rests on the lower contact 30 mounted on the housing.

Figure 3C:
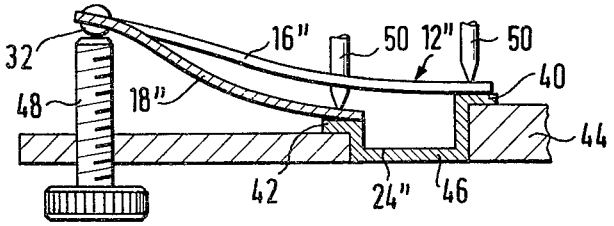
FIG. 3*c* is a section corresponding to FIG. 3*b* of the third snap switch during its mounting on a device for setting its biasing.

The snap spring 12'' of the snap switch shown in FIGS. 3*a* and 3*b* is biased by first welding the pair of outer arms 16'' to the flange 40 of the carrier 24'' and placing the two together on a base plate 44 as shown in FIG. 3*c*. The base plate 44 has an opening 46 which receives a part of the carrier 24'' and thus holds the carrier and the snap spring 12'' in a predetermined position. A set screw 48 is screwed at right angles into the base plate 44 so that the free end of the screw supports the switch contact 32 which is already firmly riveted to the snap spring 12'' and the left-hand end of the snap spring 12'' in FIG. 3*c* is held at a predetermined height. Then the free end of the central arm 18'' of the snap spring is welded onto the flange 42 of the carrier 24'', and the base plate 44 serves as a stationary electrode which co-operates with a vertically movable electrode 50.

It will be obvious to those skilled in the art that various changes may be made without departing from the scope of the invention and the invention is not to be considered limited to what is shown in the drawings and described in the specification.

What we claim is:

1. A snap switch comprising a carrier, and a snap spring fastened in said housing, said housing including a base, and a carrier raised above said base, the upper surface of said carrier being essentially flat, said snap spring including at least one switch contact connected electrically to said carrier by said snap spring, said snap spring further including a pair of outer arms and a pair of central arms, two parallel longitudinal slots separating said pair of outer arms from said pair of central arms, and a space connecting said longitudinal slots to each other, said space being arranged substantially halfway along said two longitudinal slots and separating said central arms from each other, said central arms being under compressive stress, each of said central arms being welded to said upper surface of said carrier with no portion of said carrier projecting into said space separating said central arms, said compressive stress being solely determined by the welded connections of the central arms to the carrier.

* * * * *